US008113301B2

(12) United States Patent
Eriksen

(10) Patent No.: US 8,113,301 B2
(45) Date of Patent: Feb. 14, 2012

(54) JETTED UNDERREAMER ASSEMBLY

(75) Inventor: Erik P. Eriksen, Calgary (CA)

(73) Assignee: Tesco Corporation, Houston, TX (US)

( * ) Notice: Subject to any disclaimer, the term of this patent is extended or adjusted under 35 U.S.C. 154(b) by 311 days.

(21) Appl. No.: 12/423,481

(22) Filed: Apr. 14, 2009

(65) Prior Publication Data

US 2010/0258354 A1 Oct. 14, 2010

(51) Int. Cl.
*E21B 10/32* (2006.01)

(52) U.S. Cl. ..... 175/286; 175/393

(58) Field of Classification Search ..... 175/286, 175/320, 263, 271, 273, 290, 170, 406, 393, 175/267, 92, 259
See application file for complete search history.

(56) References Cited

U.S. PATENT DOCUMENTS

| | | | | |
|---|---|---|---|---|
| 1,589,508 | A * | 6/1926 | Boynton | 175/267 |
| 1,750,953 | A * | 3/1930 | Boynton | 175/267 |
| 1,752,092 | A | 3/1930 | Kapeluchnikoff | |
| 2,049,450 | A | 8/1936 | Johnson | |
| 3,117,636 | A | 1/1964 | Wilcox et al. | |
| 4,240,683 | A * | 12/1980 | Crase | 384/613 |
| 4,995,427 | A * | 2/1991 | Berchem | 138/155 |
| 5,141,063 | A | 8/1992 | Quesenbury | |
| 5,197,553 | A * | 3/1993 | Leturno | 175/57 |
| 5,271,472 | A | 12/1993 | Leturno | |
| 5,472,057 | A * | 12/1995 | Winfree | 175/57 |
| 5,845,722 | A | 12/1998 | Makohl et al. | |
| 6,920,923 | B1 * | 7/2005 | Pietrobelli et al. | 166/55.8 |
| 7,252,163 | B2 | 8/2007 | Ollerenshaw et al. | |
| 7,520,343 | B2 | 4/2009 | Hughes et al. | |
| 2003/0029644 | A1 * | 2/2003 | Hoffmaster et al. | 175/263 |
| 2004/0222022 | A1 * | 11/2004 | Nevlud et al. | 175/57 |

FOREIGN PATENT DOCUMENTS

| | | |
|---|---|---|
| GB | 502203 | 3/1939 |

* cited by examiner

*Primary Examiner* — William P Neuder
*Assistant Examiner* — Ronald Runyan
(74) *Attorney, Agent, or Firm* — Bracewell & Giuliani LLP

(57) ABSTRACT

An underreamer for earth boring operations has a tubular body with a passage extending through it. Arms are pivotally mounted to the body and movable between retracted and extended positions. An actuator mandrel, located within the passage in the body, pushes the arms outward when drilling fluid is pumped downward in the drill string. Ports are located in the sidewall of the body and in the actuator mandrel. The ports align with each other when the mandrel moves to its downstream position. The ports divert a portion of the drilling fluid out to jet it across the cutting elements on the arms. The remaining portion of the drilling fluid passes downward to the drill bit and out nozzles of the drill bit.

12 Claims, 4 Drawing Sheets

JETTED UNDERREAMER ASSEMBLY

FIELD OF THE INVENTION

This invention relates in general to earth boring tools, and in particular to an underreamer located above a drill bit that has ports for diverting to the cutters on the underreamer arms some of the drilling fluid being pumped down the drill string.

BACKGROUND OF THE INVENTION

Underreamers are employed in well drilling operations to enlarge a pilot hole. In casing drilling, the drill string is made up of the casing that will be eventually cemented in the well. If the drill bit is retrievable, it will be part of a bottom hole assembly that latches to a collar or profile sub located near the bottom of the string of casing. The bottom hole assembly extends below the string of casing, and the drill bit is on its lower end for drilling a pilot hole. The underreamer is located above the drill bit for enlarging the pilot hole to an outer diameter greater than the outer diameter of the string of casing.

The underreamer has arms that are pivotally mounted to the body of the underreamer for moving between retracted and extended positions. Cutters, typically polycrystalline diamond disks, are mounted to the leading face of each arm. One type of underreamer has an actuator mandrel carried in its longitudinal passage, the actuator mandrel being axially movable from an upstream position to a downstream position in response to drilling fluid being pumped down the drill string. The actuator mandrel is cooperatively engaged with the arms for moving the arms to an extended position when the actuator mandrel moves to the downstream position.

The string of casing is rotated by a casing gripper and a top drive of the drilling rig. The bottom hole assembly may include a drill motor that rotates the underreamer and the drill bit independently of the casing string. During drilling, drilling fluid is pumped down the casing string, through the bottom hole assembly and out nozzles of the drill bit. The drilling fluid flows back up the borehole past the underreamer and up the annulus surrounding the string of casing. The drilling fluid removes cuttings and provides lubrication and cooling of the drill bit and underreamer. Nevertheless, in some formations, the cutters on the underreamers arms can become clogged with cuttings and operate at elevated temperatures. Elevated temperatures may be detrimental to the performance and the resistance to abrasion.

SUMMARY OF THE INVENTION

In this invention, the underreamer has an actuator mandrel carried in its longitudinal passage, the actuator mandrel being axially movable from an upstream position to a downstream position in response to drilling fluid being pumped down the drill string. The actuator mandrel is cooperatively engaged with the arms for moving the arms to an extended position when the actuator mandrel moves to the downstream position.

A body port for each arm extends through the sidewall of the underreamer body, each body port being adjacent the face of one of the arms when the arms are in the extended position. Mandrel ports extend through the sidewall of the mandrel. The mandrel ports are spaced above the body ports while the mandrel is in the upstream position. The mandrel ports align with the body ports when the mandrel is in the downstream position. Preferably an abrasion resistant nozzle forms or is mounted in each of the mandrel ports.

BRIEF DESCRIPTIONS AND DRAWINGS

DETAILED DESCRIPTION OF INVENTION

Figure 1:
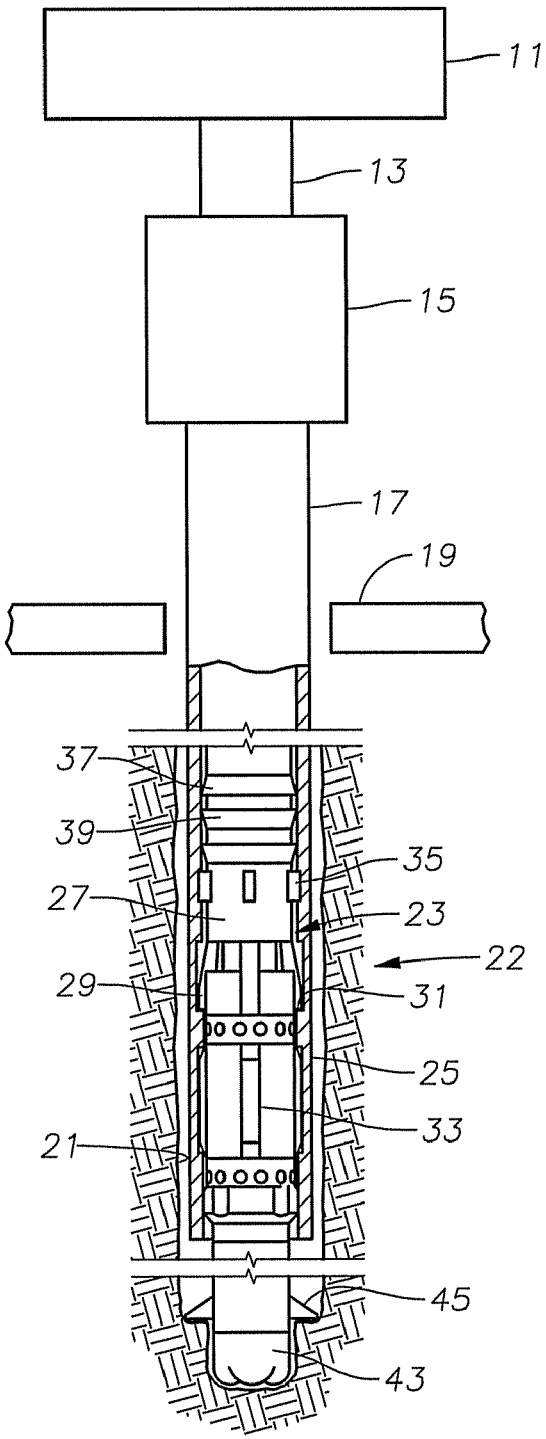
FIG. 1 is a schematic sectional view illustrating a casing drilling string and bottom hole assembly constructed in accordance with this invention.

Referring to FIG. 1, a top drive 11 of a drilling rig is schematically shown. Top drive 11 moves upward and downward in a derrick (not shown) and comprises a rotary power source having a quill 13 that rotates. A casing gripper 15 is attached to quill 13 for rotation with it. Casing gripper 15 has gripping members that engage either the inner diameter as shown or the outer diameter of conventional casing 17. Casing string 17 is shown extending from casing gripper 15 through a rig floor 19 into a borehole 21.

A bottom hole assembly 22 is releasably secured to casing string 17 near its lower end. Bottom hole assembly 22 includes a drill lock assembly ("DLA") 23, which is shown attached to a tubular collar or profile sub 25 secured into a lower end portion of casing string 17. In this example, DLA 23 has a tubular housing 27. Spring-biased stop dogs 29 extend out from housing 27 and land on an upward-facing shoulder 31 formed in profile sub 25. DLA 23 also has a set of torque keys 33 for transmitting torque between profile sub 25 and DLA 23. Torque keys 33 are also biased outward by springs in this embodiment and engage mating longitudinal slots in profile sub 25. In this embodiment, DLA 23 also has a set of axial lock members 35. Lock members 35 engage mating recesses in profile sub 25 to prevent upward movement of DLA 23 relative to profile sub 25.

DLA 23 has an upper seal 37 on its exterior arranged for preventing the upward flow of fluid from below. Upper seal 37 may be a downward facing cup seal. DLA 23 may also have one or more lower seals 39 (two shown) for preventing drilling fluid pumped down from above from flowing around the exterior of DLA 23. Lower seals 39 may also be cup seals but face upward rather than downward. Seals other than cup seals may be employed for seals 37, 39.

Bottom hole assembly 22 has a drill bit 43 at its lower end. Drill bit 43 may be any conventional drag blade type or a rolling cone type. An underreamer 45 is located in bottom hole assembly 22 above drill bit 43 and below the lower end of casing string 17. Bottom hole assembly 22 may also include a drill motor, logging tools, and steering equipment.

Figure 2:
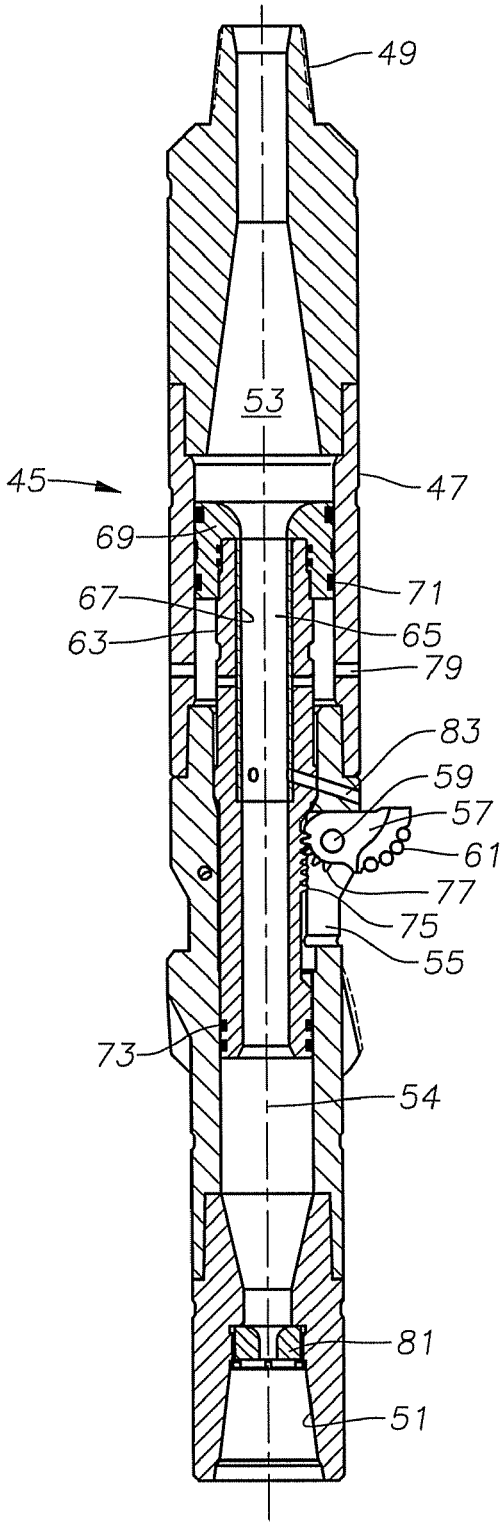
FIG. 2 is enlarged sectional view of the underreamer of the bottom hole assembly of FIG. 1.

Referring to FIG. 2, underreamer 45 has a tubular body 47 that is made up of several components in this example. Body 47 has an upper threaded end 49 and a lower threaded end 51. Upper threaded end 49 attaches to other structure in bottom hole assembly 22, and lower threaded end 51 attaches to drill bit 43. A longitudinal passage 53 extends through body 47 for transmitting drilling fluid pumped from the drilling rig down casing string 17. Body 47 and passage 53 have a longitudinal axis 54.

Figure 3:
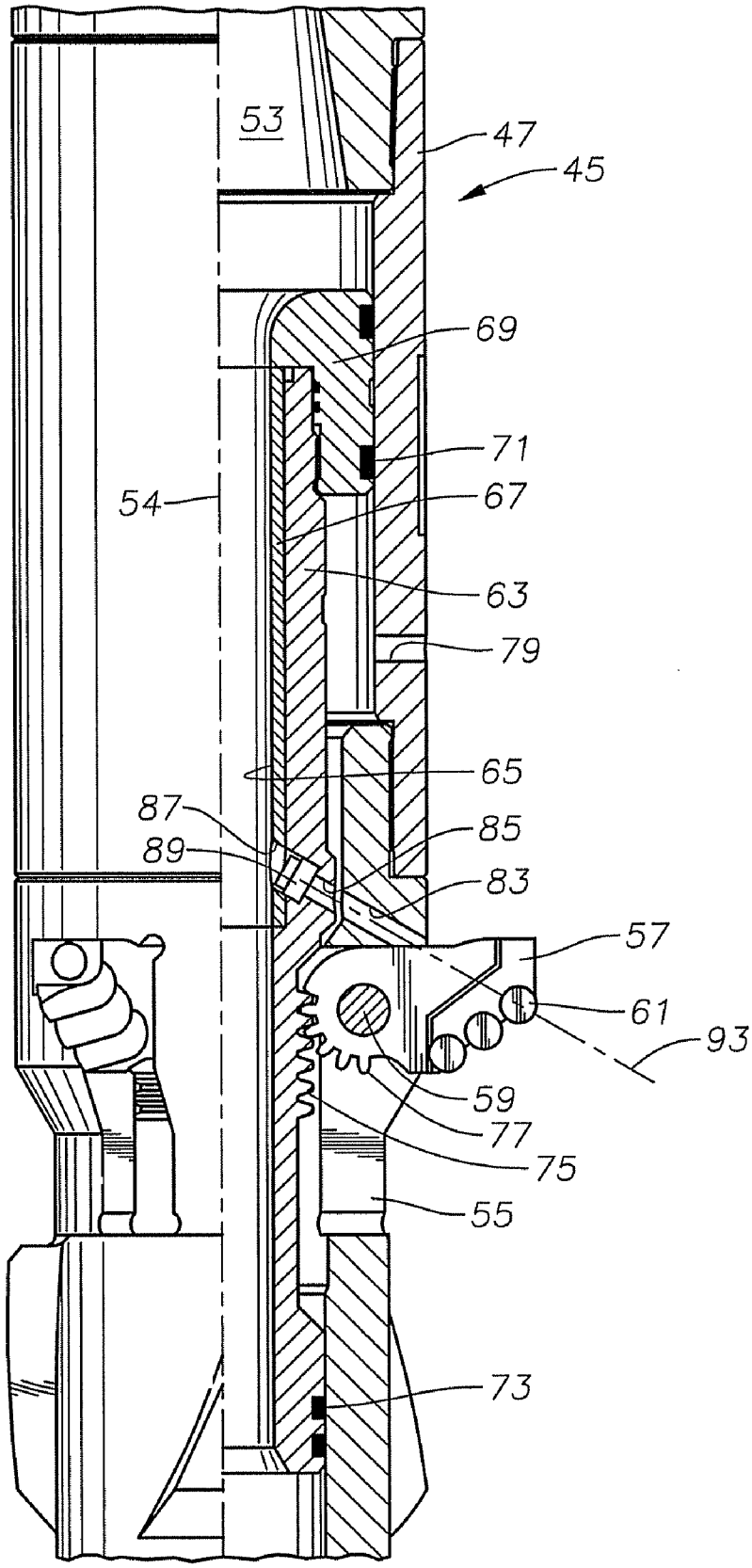
FIG. 3 is a further enlarged view of a portion of the underreamer of FIG. 2, showing an arm in the extended position.

Body 49 has a plurality of axially extending slots 55 formed in its sidewall. In this example there are three identical slots 55, each spaced about 120 degrees apart from the other around the circumference of body 47, as shown in FIG. 5. Each slot 55 extends from longitudinal passage 53 to the exterior of body 47. An arm 57 is pivotally secured within each slot 55 for movement between a retracted position (FIG. 4) and an extended position (FIG. 3). Arm 57 has a hole in an upper end through which a pivot pin 59 extends. Pivot pin 59 is secured within mating holes of body 47 on opposite sides of slot 55 to enable arm 57 to pivot between the extended position and the retracted position. Arm 55 has a forward-facing face, considering the direction of rotation, containing cutting elements 61. Preferably cutting elements 61 comprise polycrystalline diamond disks ("PDC"), each having a flat face that faces into the direction of rotation. This example shows three cutting elements 61 on each arm 57, but the number could differ.

An actuator mandrel 63 is carried within passage 53. Mandrel 63 has a mandrel passage 65 extending through it that is co-axial with passage 53. Preferably, a liner 67 is located within at least an upper portion of passage 65. Liner 67 is formed of a hard, more wear resistant material than mandrel 63. Mandrel 63 is typically formed of steel, while liner 67 may be formed of tungsten carbide, for example. An annular piston 69 is secured to the upper end of mandrel 63. Piston 69 has seals 71 on its exterior that seal and slidingly engage a cylindrical portion of passage 53. Mandrel 63 also has seals 73 on its lower end that seal and slidingly engage a smaller diameter portion of passage 53. Piston 69 is located above slots 55, and seals 73 are located below slots 55.

Mandrel 63 has a set of rack teeth 75 formed on its exterior adjacent arms 57. Rack teeth 75 extend in a straight line axially along mandrel 63. Each arm 57 has an array of gear teeth 77 formed in a partially circular array that mate with rack teeth 75. Pumping drilling fluid downward through passage 53 creates a pressure drop within mandrel passage 65 that causes mandrel 63 to move downward to the downstream position shown in FIG. 2, thereby pivoting arms 57 to the extended position. In the extended position, arms 57 will circumscribe an outer diameter that is greater than the outer diameter of casing string 17 (FIG. 1). When the drilling fluid pressure ceases and the operator pulls upward, arms 57 will move back to the retracted position to enable underreamer 45 to be pulled upward into the lower end of casing 17. Piston 69 moves back to the upstream position shown in FIG. 4.

The annular space surrounding mandrel 63 between piston seal 71 and mandrel seal 73 is not a closed chamber rather, rather it has a vent port 79 to allow fluid below piston 69 to be displaced out as piston 69 moves downward. It is not necessary that an exterior portion of mandrel 63 form a tight seal to the inner diameter of body 47 below vent port 79 and above slots 55. However, the minimum clearance between mandrel 63 and the interior of body 47 just above arms 57 is quite small.

A nozzle 81 may be located near lower threaded end 51 within passage 53. Nozzle 81 results in a pressure drop to assist in the movement of piston 69 to the lower position. After passing through nozzle 81, the drilling fluid will pass through nozzles of drill bit 43 (FIG. 1).

Figure 4:
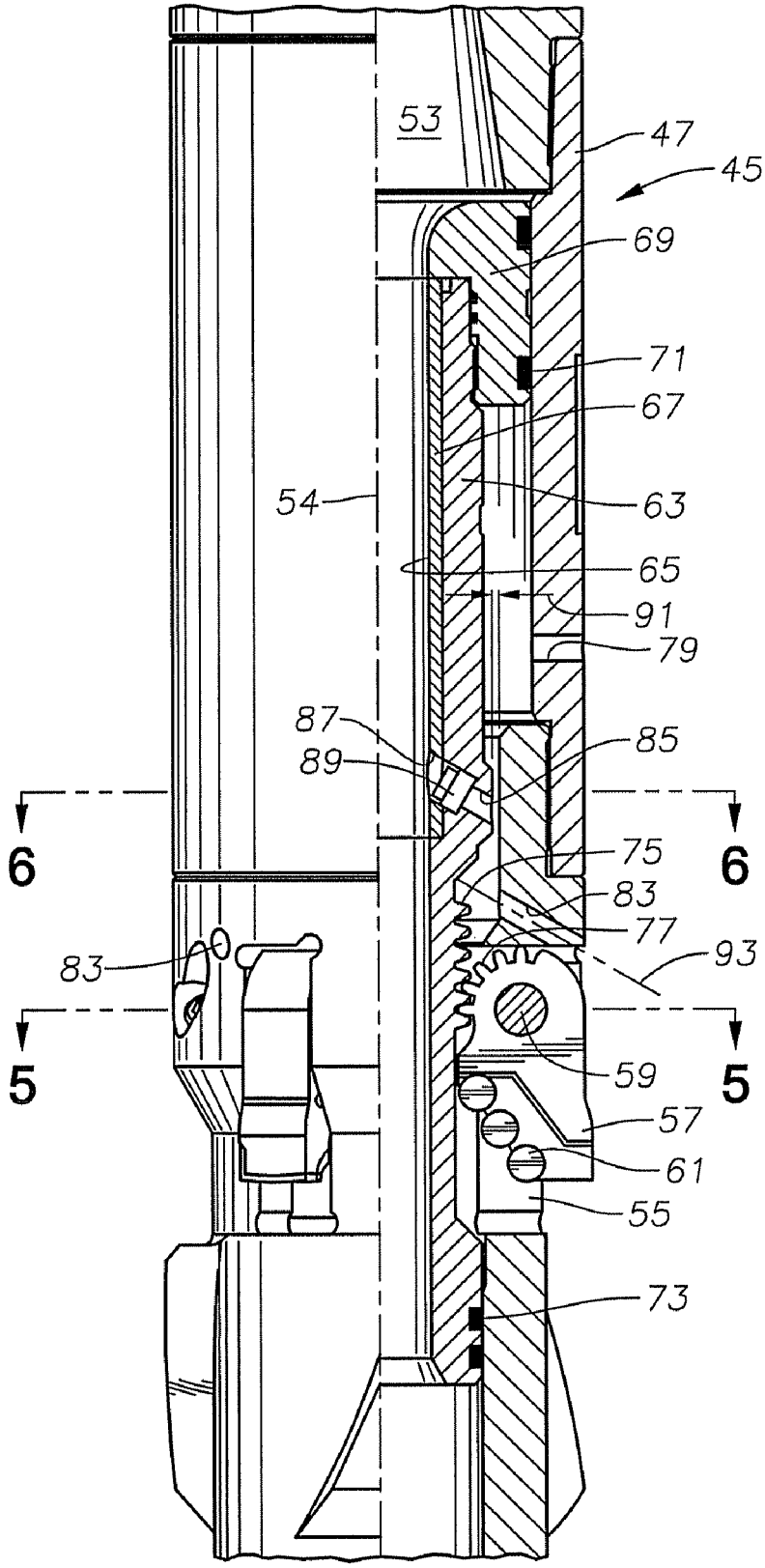
FIG. 4 is a view of the underreamer similar to FIG. 3, but showing the arm in a retracted position.
Figure 5:
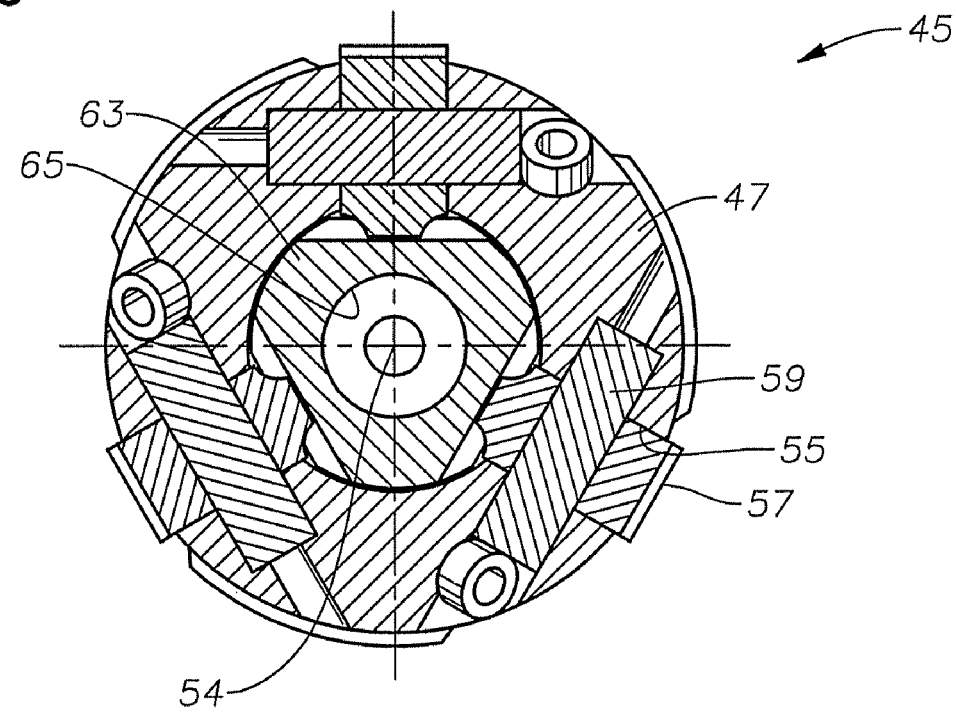
FIG. 5 is a sectional view of the underreamer of FIG. 2, taken along the line 5-5 of FIG. 4.

Referring to FIGS. 3 and 4, a body port 83 extends through the sidewall of underreamer body 47 for each of arms 57. Body port 83 has its inlet in communication with passage 53 and an outlet at the exterior of body 47. Each body port 83 is preferably inclined downward along longitudinal axes 54 of body 47, with the inlet located above the outlet. The amount of inclination may vary and, in this example, is about 30 degrees relative to a plane perpendicular to longitudinal axis 54.

A mandrel port 85 extends through the sidewall of mandrel 63 for registering with each body port 83 while mandrel 63 is in the downstream position shown in FIG. 3. Each mandrel port 85 is inclined relative to longitudinal axis 54 the same amount as each body port 83. If a liner 67 is employed, holes 87 will be formed through liner 67 for aligning with and serving as the inlets of mandrel ports 85. Preferably a nozzle 89 of hard, wear resistant material such as tungsten carbide is secured in mandrel port 85. Nozzle 89 is located at the inlet end of mandrel port 85 in this example. If mandrel 63 has a fairly thin wall construction, nozzle 89 may extend from the inlet to the outlet of mandrel port 85. In that instance, the passage through nozzle 89 becomes the mandrel port 85. The outlet of each mandrel port 85 will register with the inlet of one of the body ports 83 while mandrel 63 is in the downstream position as shown in FIG. 3. When mandrel 63 is in the upstream position shown in FIG. 4, the outlet of each mandrel port 85 will be spaced axially above the inlets of body ports 83. Optionally, there are no seals between the outlets of mandrel ports 85 and the inlets of body ports 83. Because of the internal configuration of nozzle 89, it will cause convergence of the flow stream from the mandrel passage 65 into body port 83 without significant leakage between mandrel 63 and the interior of body 47.

Referring to FIG. 3, a center line 93 of ports 83 and 85 when aligned, will pass across the flat face of the outermost cutting element 61, and will be slightly upstream from cutting elements 61 located inward of the outermost cutting element 61. However, the jetted spray diverges from port 83 so that some of it will sweep across the other cutting elements 61. The outermost cutting element 61 is typically the hottest during operation because it travels the greatest circumferential distance. Aligning centerline 93 with the outermost cutting element 61 assures that cooling fluid and lubrication will be provided. The alignment of the center line 93 with the cutting elements 61 can be varied.

Figure 6:
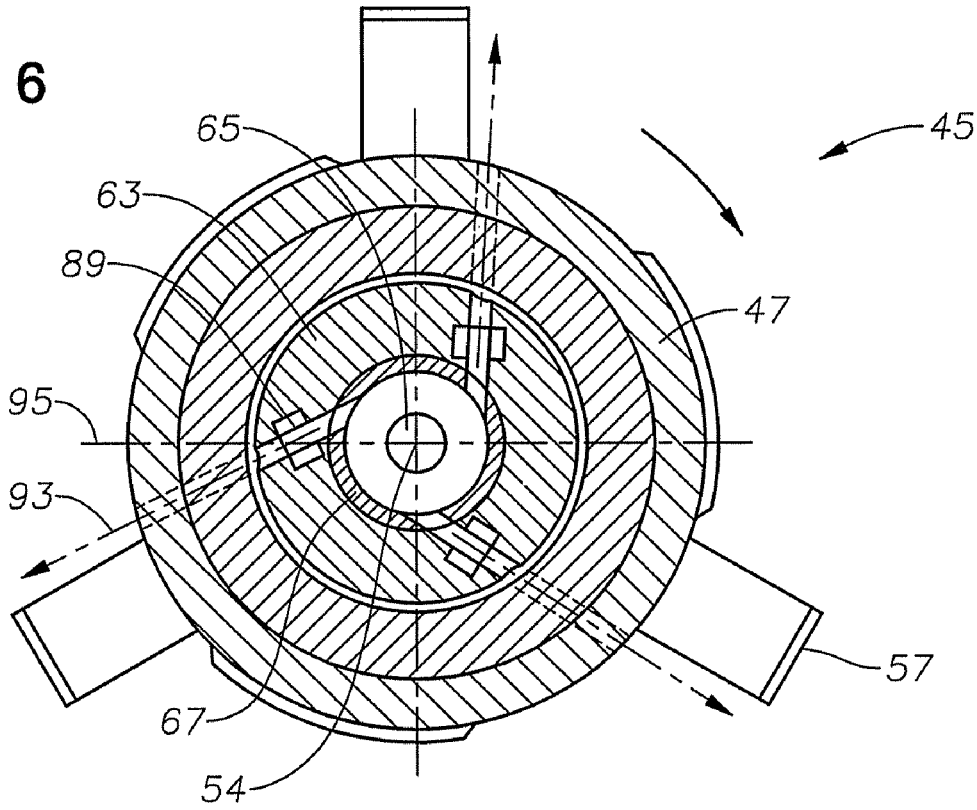
FIG. 6 is a sectional view of the underreamer of FIG. 2, taken along the line 6-6 of FIG. 4.

Referring to FIG. 6, in this example, nozzles 89 do not point along radial lines from longitudinal axis 54 of mandrel passage 65; rather centerline 93 of each nozzle 89 is at an angle to the radial line 95 that passes through the same nozzle 89. Centerline 93 thus does not intersect longitudinal axis 54. Considering the direction of rotation to be in indicated by the arrow in FIG. 6, each centerline 93 lags a radial line 95 that passes through the same nozzle 89. Each arm 57 does have a center point that would be on a radial line 95. However, the face of each arm 57 is not on a radial line 95 from axis 54, rather it is rotationally forward of the radial line. Nozzles 89 are oriented so that each centerline 93 is substantially parallel and spaced a short distance forward from the face of each arm 57. This orientation causes the jet spray to sweep across the faces of cutting elements 61 (FIG. 3).

In operation and referring to FIG. 1, bottom hole assembly 22 is secured to profile sub 25 for rotational and axial movement by dogs 29 and torque keys 33. Casing string 17 is lowered to the bottom of borehole 21. The operator operates top drive 11 to rotate casing string 17 and pumps drilling fluid down casing string 17, which flows into the upper end of bottom hole assembly 22. The drilling fluid pressure pushes piston 69 (FIG. 2) downward, moving arms 57 to the extended position. Some of the drilling fluid is jetted out ports 85 and 83 and discharges across cutting elements 61 of each arm 57. The remaining drilling fluid flows out nozzles of drill bit 43 and back up around arms 57 and casing string 17 to the surface. The drilling fluid being jetted out ports 85 and 83 provides cooling, lubrication, and cleaning for cutting elements 61 of underreamer arms 57.

While the invention has been shown in only one of its forms, it should be apparent to those skilled in the art, that it is not so limited but is susceptible to various changes without departing from the scope of the invention.

The invention claimed is:

1. An apparatus for earth boring, comprising:

a tubular body having one end for securing to a drill string and another end for securing to a drill bit;

a passage extending through the body along a longitudinal axis of the body;

a plurality of arms pivotally mounted to the body and movable between a retracted position and an extended position, each of the arms having a face containing a plurality of cutting elements mounted thereon;

an actuator mandrel carried in the passage, the actuator mandrel being axially movable from an upstream position to a downstream position in response to drilling fluid being pumped down the drill string, the actuator mandrel being cooperatively engaged with the arms for moving the arms to the extended position when the actuator mandrel moves to the downstream position;

a plurality of body ports extending through a sidewall of the body, each body port being adjacent the face of one of the arms when the arms are in the extended position; and a plurality of mandrel ports extending through a sidewall of the mandrel, each of the mandrel ports being axially offset from one of the body ports while the mandrel is in the upstream position and aligned with one of the body ports while the mandrel is in the downstream position for discharging a portion of the drilling fluid across the face of one of the arms;

a liner located within and axially movable with the mandrel, the liner being formed of a more wear resistant material than the mandrel; and wherein the mandrel ports extend through the liner.

2. The apparatus according to claim 1, further comprising:

a nozzle of a wear resistant material secured within each of the mandrel ports.

3. The apparatus according to claim 1, wherein the mandrel ports and the body ports incline relative to the axis of the body.

4. The apparatus according to claim 1, wherein:

each of the arms has an innermost one of the cutting elements and an outermost one of the cutting elements; and wherein a centerline of each of the body ports is aligned with the outermost one of the cutting elements on one of the arms when the arms are in the extended position.

5. The apparatus according to claim 1, wherein a centerline of each of the mandrel ports is at an angle relative to a radial line passing from the longitudinal axis through the same mandrel port.

6. The apparatus according to claim 1, wherein:

the mandrel ports have outlets and the body ports have inlets that register with each other while the mandrel is in the downstream position.

7. The apparatus according to claim 1, further comprising:

a piston on the mandrel that seals to and engages an interior portion of the body; and a vent port through the sidewall of the body below the piston and above the arms.

8. An apparatus for earth boring, comprising:

a tubular body having one end for securing to a drill string and another end for securing to a drill bit;

a body passage extending through the body along a longitudinal axis of the body;

a plurality of arms pivotally mounted to the body and movable between a retracted position and an extended position, each of the arms having a face containing a plurality of cutting elements mounted thereon, the cutting elements comprising flat disks;

an actuator mandrel carried in the passage and having a mandrel passage axially aligned with the body passage;

a piston on the mandrel that slidingly and sealingly engages an inner diameter portion of the body, the piston axially moving, the mandrel from an upstream position to a downstream position in response to drilling fluid being pumped down the drill string;

rack and pinion gear teeth formed on the mandrel and each of the arms for moving the arms to the extended position when the actuator mandrel moves to the downstream position;

a plurality of body ports extending through a sidewall of the body at an inclination relative to the axis, each body port having an inlet in the body passage and an outlet adjacent the face of one of the arms when the arms are in the extended position;

a plurality of mandrel ports extending through a sidewall of the mandrel at an inclination relative to the axis, each of the mandrel ports having an inlet in the mandrel passage and an outlet that registers with the inlet of one of the body ports while the mandrel is in the downstream position;

a nozzle of a wear resistant material located within each of the mandrel ports;

a liner located within and axially movable with the mandrel, the liner being formed of a more wear resistant material than the mandrel; and wherein the mandrel ports extend through the liner.

9. An apparatus for earth boring, comprising:

a tubular body having one end for securing to a drill string and another end for securing to a drill bit;

a body passage extending through the body along a longitudinal axis of the body;

a plurality of arms pivotally mounted to the body and movable between a retracted position and an extended position, each of the arms having a face containing a plurality of cutting elements mounted thereon, the cutting elements comprising flat disks;

an actuator mandrel carried in the passage and having a mandrel passage axially aligned with the body passage;

a piston on the mandrel that slidingly and sealingly engages an inner diameter portion of the body, the piston axially moving the mandrel from an upstream position to a downstream position in response to drilling fluid being pumped down the drill string;

rack and pinion gear teeth formed on the mandrel and each of the arms for moving the arms to the extended position when the actuator mandrel moves to the downstream position;

a plurality of body ports extending through a sidewall of the body at an inclination relative to the axis, each body port having an inlet in the body passage and an outlet adjacent the face of one of the arms when the arms are in the extended position;

a plurality of mandrel ports extending through a sidewall of the mandrel at an inclination relative to the axis, each of the mandrel ports having an inlet in the mandrel passage and an outlet that registers with the inlet of one of the body ports while the mandrel is in the downstream position;

a nozzle of a wear resistant material located within each of the mandrel ports; and wherein a centerline extending through each of the mandrel ports will coincide with a centerline of one of the body ports while the mandrel is in the downstream position.

10. The apparatus according to claim 9, wherein:

each of the arms has an outermost one of the cutting elements; and wherein a centerline of each of the body ports aligns with the outermost one of the cutting elements on one of the arms when the arms are in the extended position.

11. The apparatus according to claim 9, wherein a centerline of each of the body ports is substantially parallel with the face of one of the arms when the arms are in the extended position.

12. The apparatus according to claim 9, wherein:

a vent port extends through the sidewall of the body below the piston.

* * * * *